US007037210B2

(12) United States Patent
Bainter

(10) Patent No.: US 7,037,210 B2
(45) Date of Patent: May 2, 2006

(54) GOLF ALIGNMENT DEVICE

(76) Inventor: Daniel A. Bainter, 2945 Carroll Eastern Rd. NW., Carroll, OH (US) 43112

( * ) Notice: Subject to any disclaimer, the term of this patent is extended or adjusted under 35 U.S.C. 154(b) by 0 days.

(21) Appl. No.: 10/444,698

(22) Filed: May 23, 2003

(65) Prior Publication Data

US 2003/0220151 A1 Nov. 27, 2003

Related U.S. Application Data

(60) Provisional application No. 60/382,975, filed on May 24, 2002.

(51) Int. Cl.
*A63B 69/36* (2006.01)

(52) U.S. Cl. ..... 473/270

(58) Field of Classification Search ..... 473/270, 473/272, 273, 266, 218; 403/300, 305, 309, 403/292, 294, 230, 174; 446/122–126, 114
See application file for complete search history.

(56) References Cited

U.S. PATENT DOCUMENTS

| | | | | | |
|---|---|---|---|---|---|
| 1,400,066 | A | * | 12/1921 | Adolf | 446/123 |
| 1,446,868 | A | * | 2/1923 | Baker | 446/126 |
| 1,517,555 | A | * | 12/1924 | Graham | 33/508 |
| 2,117,798 | A | * | 5/1938 | Harry et al. | 403/174 |
| 2,755,981 | A | * | 7/1956 | Edwards | 182/206 |
| 4,322,084 | A | * | 3/1982 | Reece et al. | 473/273 |
| 4,384,718 | A | | 5/1983 | Cachola | |
| 4,538,815 | A | | 9/1985 | Poirier | |
| 4,647,048 | A | | 3/1987 | Welch | |
| 4,718,674 | A | * | 1/1988 | Henry | 473/218 |
| 4,925,192 | A | * | 5/1990 | Forbes | 473/273 |
| 4,993,716 | A | * | 2/1991 | Waller | 473/275 |
| 5,042,815 | A | | 8/1991 | Sutton | |
| 5,108,106 | A | | 4/1992 | Cook | |
| 5,203,453 | A | | 4/1993 | Dirito | |
| 5,322,288 | A | | 6/1994 | Amis | |
| 5,362,060 | A | | 11/1994 | Hinson | |
| 5,411,266 | A | | 5/1995 | Guthry | |
| 5,435,727 | A | * | 7/1995 | Dobson | 434/252 |
| 5,478,082 | A | | 12/1995 | De Knight et al. | |
| 5,707,300 | A | * | 1/1998 | May et al. | 473/257 |
| 5,730,659 | A | | 3/1998 | Morita | |
| 5,827,128 | A | | 10/1998 | Finch et al. | |
| 5,860,871 | A | * | 1/1999 | Marley, Jr. | 473/218 |
| 5,893,805 | A | | 4/1999 | Douglass | |
| 5,947,832 | A | | 9/1999 | Gagne | |
| 5,976,027 | A | | 11/1999 | Kachmar | |
| 5,984,801 | A | | 11/1999 | Mason | |
| 6,050,902 | A | | 4/2000 | McCrink Jr. | |
| 6,059,668 | A | * | 5/2000 | Marley, Jr. | 473/220 |
| 6,106,408 | A | | 8/2000 | Roman | |
| 6,171,201 | B1 | | 1/2001 | Tiller | |
| 6,402,581 | B1 | * | 6/2002 | Podgaiz | 446/107 |
| 2003/0220151 | A1 | * | 11/2003 | Bainter | 473/270 |

* cited by examiner

*Primary Examiner*—Raleigh W. Chiu
(74) *Attorney, Agent, or Firm*—William Rambo

(57) ABSTRACT

At least four alignment members, namely, an aim member 11, a guide member 12, and two positioning members 13, 14, may be arranged in various configurations to assist the golfer with putts and with wood and iron shots. A connector 25 is disposed at an end 27 of each of the guide and positioning members 12–14. A member-receiving passageway 29 is formed on each of the connectors 25 and extends generally perpendicularly to the elongated member 12–14 upon which the connector 25 is disposed.

9 Claims, 4 Drawing Sheets

GOLF ALIGNMENT DEVICE

RELATED APPLICATION

A claim is hereby made to the benefit of U.S. Provisional Application No. 60/382,975 filed May 24, 2002.

BACKGROUND OF THE INVENTION

The present golf alignment device relates to practice and training apparatus for golfers and more particularly to those devices which are portable and which assist the golfer in establishing the proper stance, stroke, and/or swing.

SUMMARY OF THE INVENTION

The present golf alignment device basically comprises at least four alignment members, namely, an aim member, a guide member, and two positioning members; a connector disposed at an end of each of the guide and positioning members and adapted to join the members together in a selected configuration; and a member-receiving passageway which is formed on each of the connectors and which extends generally perpendicularly to the alignment member upon which the connector is disposed.

DETAILED DESCRIPTION OF THE PREFERRED EMBODIMENT

Figure 1:
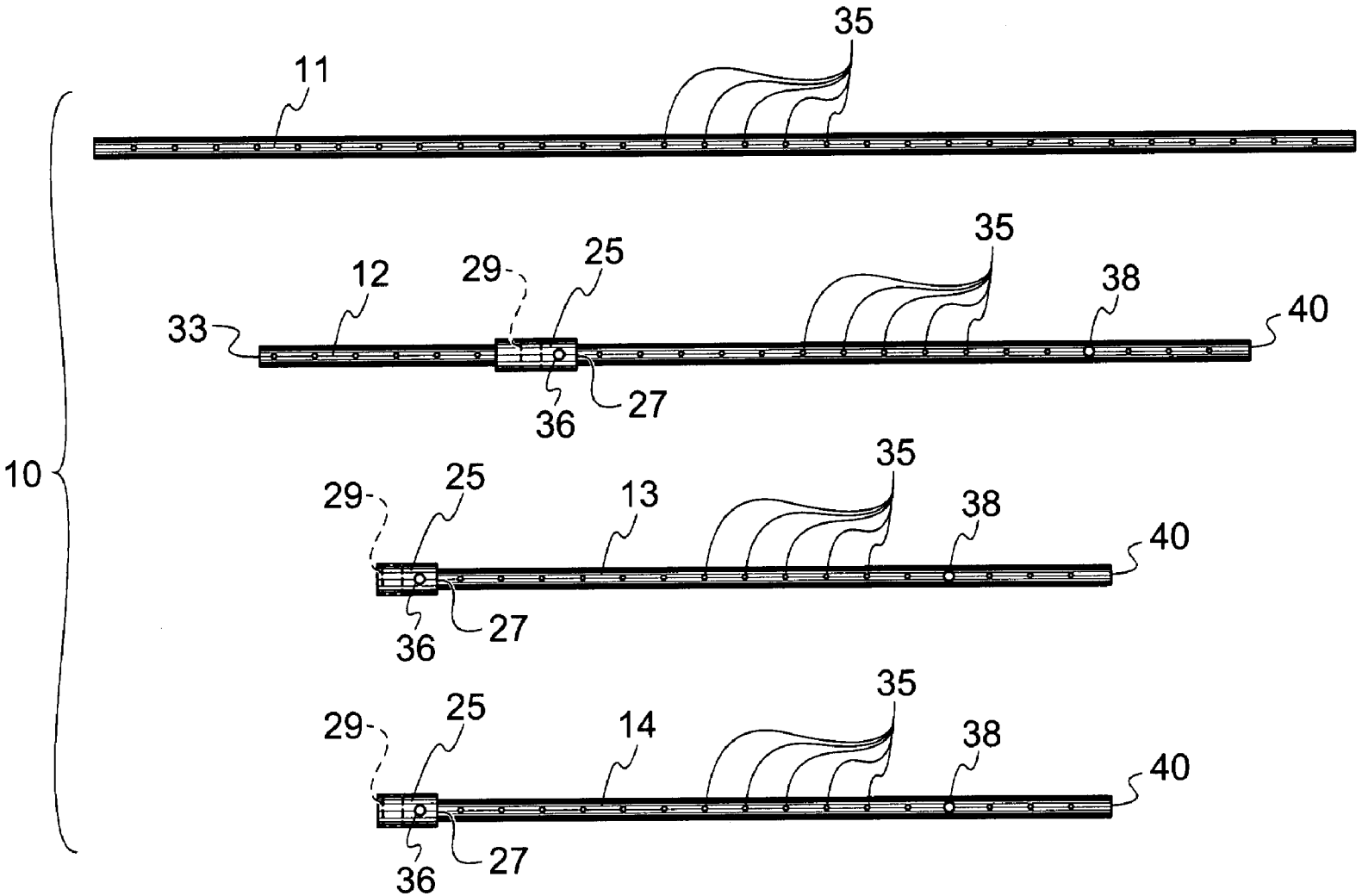
FIG. 1 is a top plan view of the components of a preferred embodiment of the present golf alignment device.

As variously illustrated in FIGS. 1–5, the present golf alignment device, generally designated 10, basically comprises at least four alignment members, namely, an aim member 11, a guide member 12, and two positioning members 13, 14; a connector 25 disposed at an end 27 of each of the guide and positioning members 12–14 and adapted to join the members 11–14 together in a selected configuration; and a member-receiving passageway 29 which is formed on each of the connectors 25 and which extends generally perpendicularly to the elongated member 12–14 upon which the connector 25 is disposed.

Figure 3:
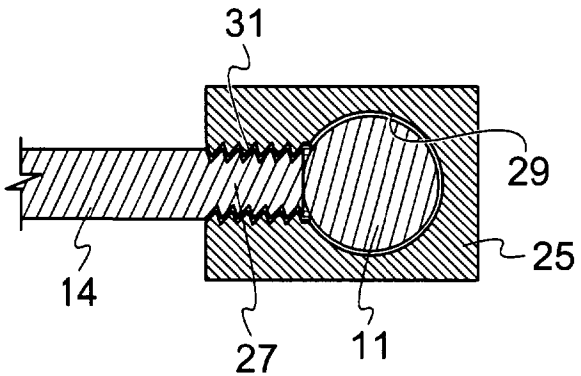
FIG. 3 is an enlarged sectional view taken along line 3—3 of FIG. 2 and particularly illustrates a preferred manner in which each of the connectors engage the members of the present alignment device.

As illustrated in FIG. 3, a threaded bore 31 preferably extends from one end of each of the connectors 25 into the member-receiving passageway 29, and the ends 27 of the guide and positioning members 12–14 are threaded to be rotatably advanced and withdrawn from the threaded bore 31. As may be readily understood, the threaded end 27 of one member 14 may be advanced in the connector 25 to engage the alignment member 11 in the passageway 29 and secure it in place, or it may be withdrawn to permit the alignment member 11 to slide freely in the passageway 29. In this manner, the alignment members 11–14 may be disassembled for transport or storage or assembled and set relative to one another to provide the configurations illustrated and described herein. Preferably, the alignment members 11–14 are formed from ½ inch diameter aluminum alloy rounds, and the connectors 25 are formed from ¾ inch diameter synthetic resin material such as Delrin® (acetal rod). Preferably, the device comes with a carrying bag (not shown) to keep the individual parts together and is adapted to fit inside a golf bag so it can be transported easily to and from the practice range or golf course.

As illustrated in FIGS. 1,2,4 and 5, the connector 25 which is disposed on the guide member 12 is preferably provided with an extension 32 projecting outwardly from the connector 25 in generally axial alignment with the guide member 12. The extension 32 assists with foot and ball positioning as described herein.

As illustrated in FIG. 1, each of the alignment members 11–14 is preferably provided with a plurality of equally spaced apart, longitudinally aligned dots or other surface markings 35 which are helpful in repositioning the present practice device 10 in its various configurations after it has been disassembled or readjusted for another golfer. In addition, each of the connectors 25 on the guide and positioning members 12–14 is preferably provided with a marker 36 which, in combination with the dots 35 on the alignment members 12–14 assist in properly tightening the ends 27 of guide and positioning members 12–14 against the members extending through the passageways 29. In particular, when a marker 36 on one of the connectors 25 is face up, the alignment member 12–14 threaded into that connector is properly tightened when the dots 27 on the alignment member are aligned with the marker on the connector.

As further illustrated in FIG. 1, each of the guide member 12 and the positioning members 13, 14 is preferably provided with a tee-receiving bore 38 which is aligned with the dots 35 and which extends through the member 12–14 near the free ends 40 thereof. Once the alignment members 11–14 are properly positioned, as described below, golf tees (not shown) may be inserted through the bores 38 and into the ground to hold the present practice device in place.

Figure 2:
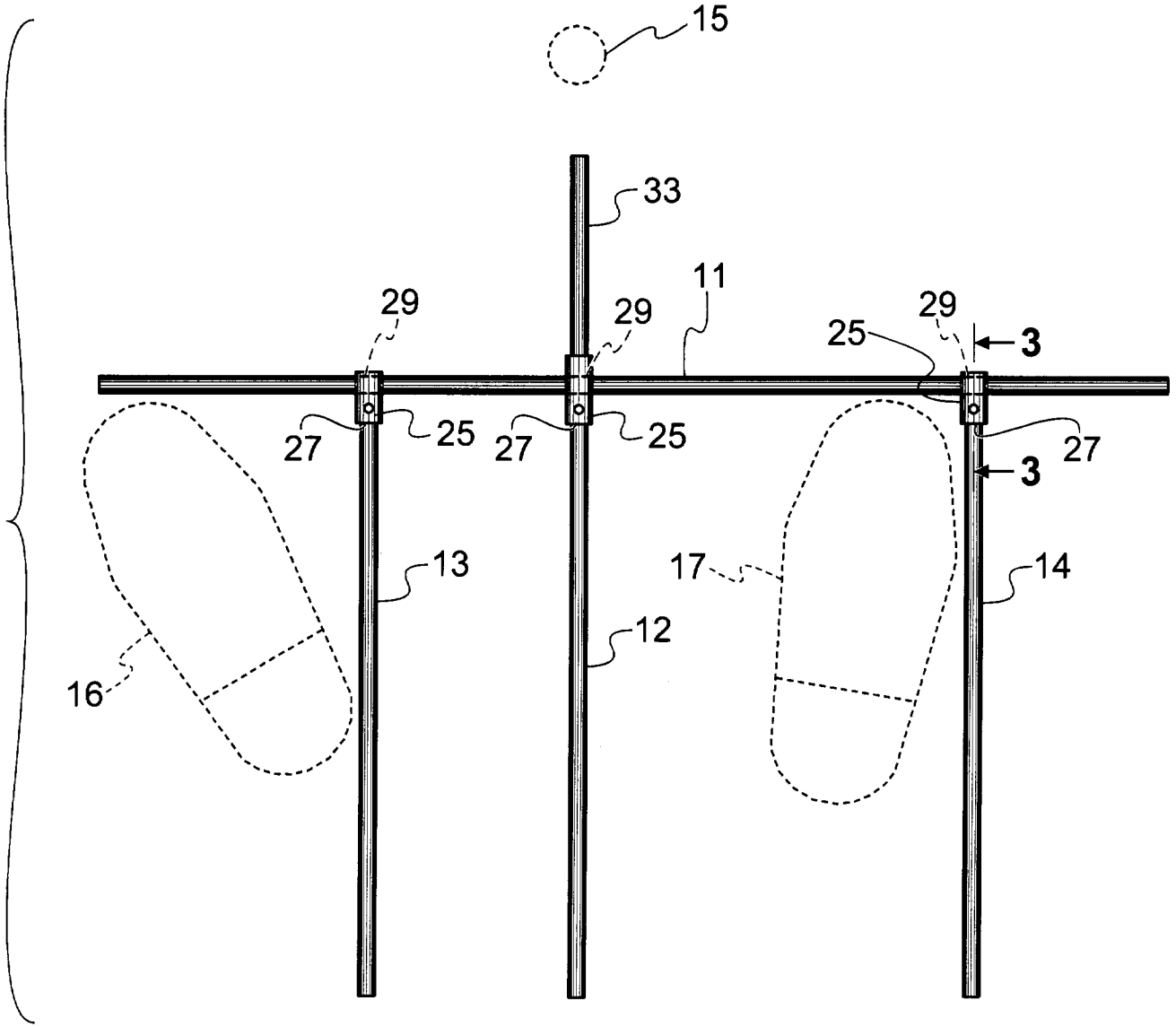
FIG. 2 is a top plan view of the preferred embodiment wherein the components are assembled to assist the golfer with wood or iron shots.

FIG. 2 illustrates a configuration which enables the golfer to properly practice with a driver or an iron. In this configuration, the aim member 11 is placed on the ground with its long axis aligned with a desired target on the golf course or practice area. The guide member 12 is disposed between the positioning members 13, 14, and all three alignment members 12–14 are mounted on the aim member 11 by their connectors 25 and extend lengthwise in the direction of the golfer. The present invention assists in arranging the feet 16, 17 of the golfer in proper alignment to provide a good square stance in relation to an axis or aim line defined by the aim member 11. The positioning members 13, 14 are adjusted laterally along the aim member 11 to establish the desired distance between the golfer's feet 16, 17 and then tightened against the aim member 11 as described above. Advantageously, the aim member 11 provides a visual reference to make sure the golfer's shoulders are square. Another fundamental is ball position. The guide member 12 is adjusted laterally along the aim member 11 between the positioning members 13, 14 to establish the desired ball position and then tightened. The extension 33 on the guide member 12 assists the golfer in aligning the guide member 12 with the golf ball 15. The present device 10 can be easily adjusted so the golfer can practice with different clubs and take different types of shots. For instance, the guide member 12 can be shifted to the left so that a driver may be used to hit a golf ball 15 off of the inside of the golfer's left foot 16 or so that an iron may be used to hit a chip shot with the golf ball 15 positioned closer to the inside of the golfer's right foot 17. Likewise, the positioning members 13, 14 may be moved along the aim member 11 to adjust the golfer's stance to suit the type of shot being practiced.

The present invention provides the foregoing advantages by giving the golfer mechanical and visual references that address three fundamentals of golf: the stance, the aim, and the ball position.

The subject device 10 is readily adjustable to suit the golfer's age, gender and size to provide the proper stance width by adjusting the positioning members 13, 14. Proper stance width promotes good posture and a good turn, both back and through the ball.

Figure 5:
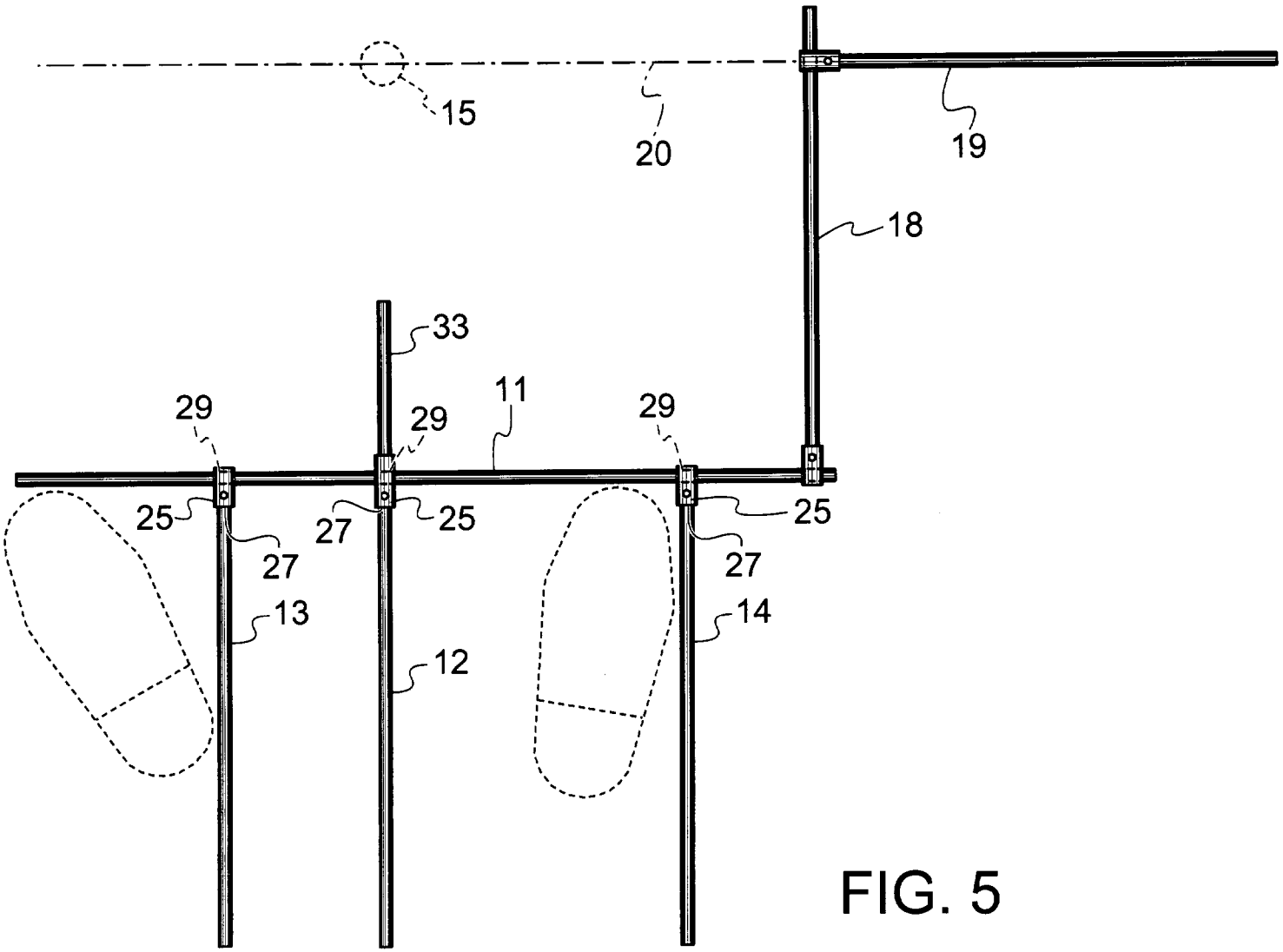
FIG. 5 is a top plan view of the preferred embodiment wherein additional components provide a target line to assist the golfer's swing.

As illustrated in FIG. 5, third and fourth positioning members 18, 19 may be added to the present device 10 to show the golfer the proper swing path which keeps the swing on the proper target line or swing plane 20 which improves the likelihood of the ball 15 traveling towards the intended target.

Figure 4:
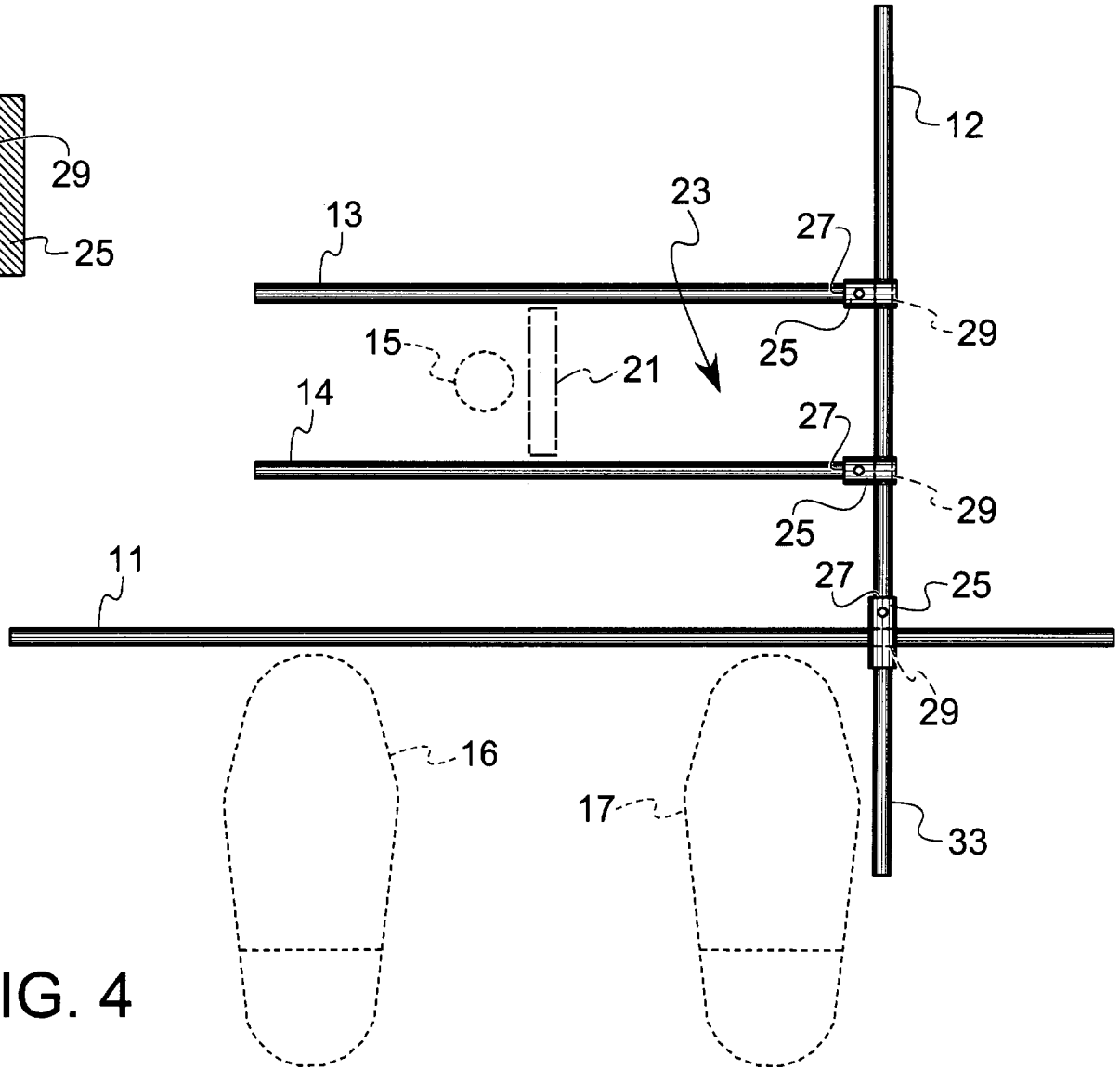
FIG. 4 is a top plan view of the preferred embodiment wherein the components are assembled to assist the golfer with putts.

As illustrated in FIG. 4, the components of the present device 10 may be assembled to help the golfer when using a putter 21. This is accomplished by again, giving the golfer the proper fundamentals. A square stance is assisted by the aim member 11. The guide member 12 is inverted and shifted so that the extension 33 assists in positioning the golfer's right foot 17. The positioning members 13, 14 are then mounted and positioned on the guide member 12 to define a pathway for the putter 21 to promote a putting stroke that goes straight back and straight through towards the target. For an advanced golfer, one of the positioning members 13, 14 may remain connected to the aim member 11 to assist with left foot 16 placement, and the other positioning member 13,14 is mounted and positioned on the guide member 12 to keep the golfer from making a stroke that strays inside or outside of the positioning member, depending upon whether it is positioned above or below the putter 21.

Preferably the present device 10 also has a marking system so that it can be assembled in a selected configuration time and time again. This way if the correct posture is established, then it can be repeated. This also can be established for specific clubs and shots. Even in putting, were the ball should be a specific distance from the end of the toes with your eyes straight above the ball. Once it is established the device can be taken apart and put back together to the same position in seconds. This allows you to continuously practice good fundamental habits, which in the long run will make you a better golfer.

While the present golf alignment device 10 has been illustrated and described in some detail, the foregoing disclosure is not intended to unduly limit or restrict the spirit of the invention or the scope of the following claims.

The invention claimed is:

1. A golf alignment device comprising:

An aim member;

A guide member;

First and second positioning members;

A connector disposed at an end of each of said guide and first and second positioning members, said connectors being adapted to join the members together in a selected configuration;

A member-receiving passageway formed on each of the connectors, said passageway extending generally perpendicularly to the member upon which the connector is disposed, said passageway extending completely through said connector for slidably receiving only one other member; and Wherein each of the connectors is formed with a threaded bore extending from one end thereof to the member-receiving passageway and wherein the ends of the guide and first and second positioning members on which the connectors are disposed are threaded to be rotatably advanced and withdrawn from the member-receiving passageways of said connectors.

2. The golf alignment device according to claim 1, wherein each of the aim, guide and first and second positioning members is provided with a plurality of generally equally spaced apart, longitudinally aligned surface markings.

3. The golf alignment device according to claim 2, wherein each of the connectors on the guide and first and second positioning members is provided with a marker, said marker and said surface markings on the guide and first and second positioning members being aliguable to indicate that a member extending through the passageway of said connector is secured in place.

4. The golf alignment device according to claim 2, wherein each of the guide and first and second positioning members is provided with a tee-receiving bore extending therethrough in alignment with the surface markings thereon.

5. The golf alignment device according to claim 1, wherein the aim member is positioned in axial alignment with a selected target and extends through the member-receiving passageways of the connectors disposed on the guide and the first and second positioning members, said guide member being disposed in spaced relation between and extending in the same direction as the first and second positioning members.

6. The golf alignment device according to claim 1, wherein third and fourth positioning members are provided and wherein the third positioning member is mounted on the aim member and the fourth positioning member is mounted on the third positioning member in parallel and offset relation to the aim member.

7. The golf alignment device according to claim 1, wherein the aim member is to be axially aligned with a selected target and extends through the member-receiving passageway of the connector disposed on the guide member, and the guide member extends through the member-receiving passageway of the connector disposed on the first positioning member, said first positioning member being disposed in spaced, parallel relation to the aim member.

8. The golf alignment device according to claim 1, wherein the aim member is to be axially aligned with a selected target and extends through the member-receiving passageway of the connector disposed on the guide member, and the guide member extends through the member-receiving passageway of the connector disposed on the second positioning member, said second positioning member being disposed in spaced, penile!relation to the aim member.

9. The golf alignment device according to claim 1, wherein the aim member is to be axially aligned with a selected target and extends through the member-receiving passageway of the connector disposed on the guide member, and the guide member extends through the member-receiving passageways of the connectors disposed on the first and second positioning members, said first and second positioning members being disposed in space, parallel relation to the aim member.

* * * * *